US009386869B2

(12) United States Patent
Kamping et al.

(10) Patent No.: US 9,386,869 B2
(45) Date of Patent: Jul. 12, 2016

(54) COVER DEVICE FOR A DRINK CONTAINER

(71) Applicant: KONINKLIJKE PHILIPS N.V., Eindhoven (NL)

(72) Inventors: Wiecher Ferdinand Kamping, Eindhoven (NL); Bastiaan Uitbeijerse, Eindhoven (NL); Peter Ronald Van Den Broek, Eindhoven (NL); Maarten Joannes Botman, Eindhoven (NL); Jacob Brinkert, Eindhoven (NL); Christoph Dobrusskin, Eindhoven (NL)

(73) Assignee: KONINKLIJKE PHILPS N.V., Eindhoven (NL)

( * ) Notice: Subject to any disclaimer, the term of this patent is extended or adjusted under 35 U.S.C. 154(b) by 0 days.

(21) Appl. No.: 14/427,113

(22) PCT Filed: Nov. 27, 2013

(86) PCT No.: PCT/EP2013/074796

§ 371 (c)(1),
(2) Date: Mar. 10, 2015

(87) PCT Pub. No.: WO2014/086625

PCT Pub. Date: Jun. 12, 2014

(65) Prior Publication Data

US 2015/0265079 A1 Sep. 24, 2015

Related U.S. Application Data

(60) Provisional application No. 61/734,433, filed on Dec. 7, 2012.

(30) Foreign Application Priority Data

Dec. 7, 2012 (EP) ..... 12196135

(51) Int. Cl.

| | |
|---|---|
| ***A47G 19/22*** | (2006.01) |
| ***B65D 47/06*** | (2006.01) |
| ***A61J 11/04*** | (2006.01) |
| ***B65D 51/16*** | (2006.01) |

(52) U.S. Cl.
CPC ..... *A47G 19/2272* (2013.01); *A61J 11/04* (2013.01); *B65D 47/06* (2013.01); *B65D 51/1644* (2013.01)

(58) Field of Classification Search
CPC ..... A47C 19/2272; B65D 51/1644; B65D 47/06; A61J 11/04
See application file for complete search history.

(56) References Cited

U.S. PATENT DOCUMENTS

| | | | | |
|---|---|---|---|---|
| 4,135,513 | A | 1/1979 | Arisland | |
| 2003/0037820 | A1 | 2/2003 | Williamson | |
| 2006/0169694 | A1 | 8/2006 | Kemper | |
| 2010/0294765 | A1* | 11/2010 | Kemper | A47G 19/2272 220/203.18 |

FOREIGN PATENT DOCUMENTS

| | | | |
|---|---|---|---|
| GB | 2333770 | A | 8/1999 |

* cited by examiner

*Primary Examiner* — Andrew Perreault

(57) ABSTRACT

A cover device (2) for a drink container comprises a basic assembly (9) which is provided with a drink opening (32), and a valve arrangement (20) for blocking or unblocking a passage to the drink opening (32) from a drink container side of the cover device (2). The valve arrangement (20) comprises a valve element (26) having two portions (27, 28) which are connected to each other through an area of the valve element (26) at a position where the valve element (26) is hingably associated with the basic assembly (9), and wherein only one of the two portions (27, 28) is in direct communication with the drink opening (32) of the basic assembly (9), so that a smallest total moment of force may be realized on the one portion (28) when the valve element (26) is subjected to pressure from the drink container side of the cover device (2).

6 Claims, 9 Drawing Sheets

FIG. 13
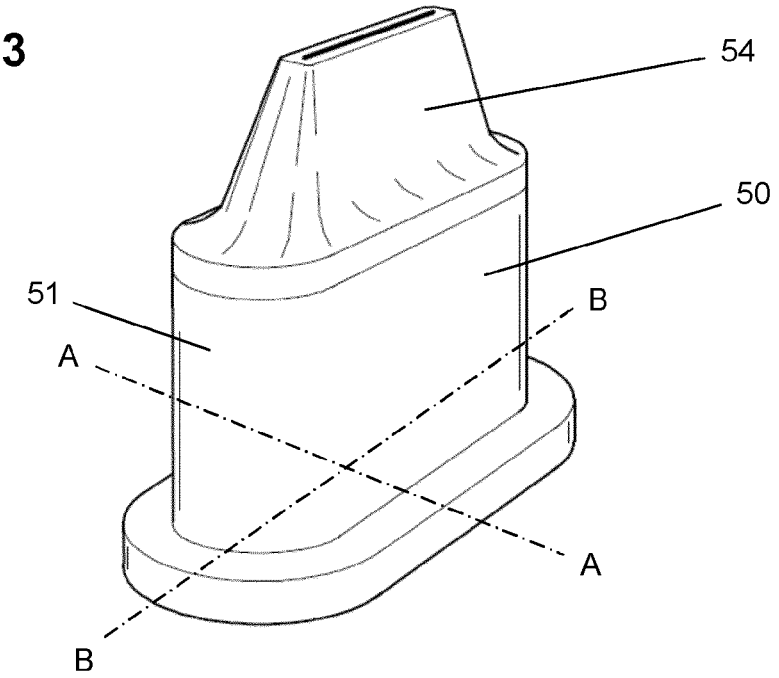
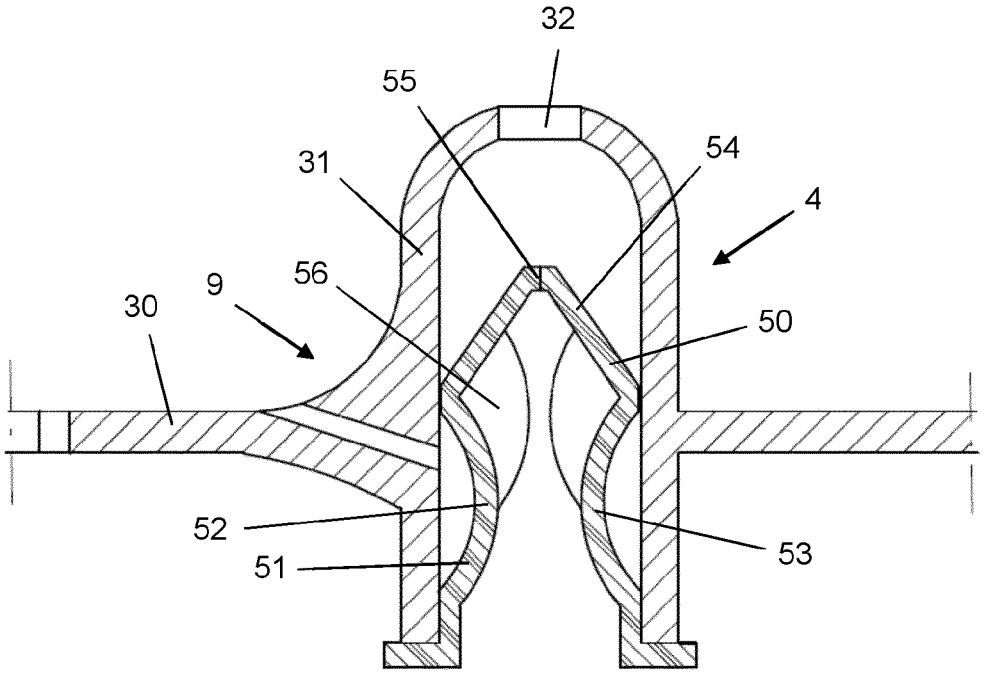
FIG. 14

COVER DEVICE FOR A DRINK CONTAINER

This application is the U.S. National Phase application under 35 U.S.C. §371 of International Application No. PCT/EP2013/074796, filed on Nov. 27, 2013, which claims the benefit of U.S. Provisional Application No. 61/734,433 filed on Dec. 7, 2012 and International Application No. 12196135.3 filed on Dec. 7, 2012. These applications are hereby incorporated by reference herein.

FIELD OF THE INVENTION

The present invention relates to a cover device for a drink container, comprising a basic assembly having a drink opening, and a valve arrangement. In an embodiment, the valve arrangement is associated with the basic assembly, and is adapted to assume various states for determining an extent to which a passage to the drink opening in the basic assembly from a side of the cover device which is intended to face the drink container is blocked.

The present invention also relates to an assembly of a drink container and a cover device as mentioned, wherein the cover device is removably attached to the drink container.

BACKGROUND OF THE INVENTION

It is a well-known fact that it is difficult to let a small child drink from an open drink container such as a cup without spilling the content of the drink container. The small child cannot make all the complex movements that are needed, and is not capable of controlling the extent to which the drink container needs to be gradually tilted in the process. Even if the child is assisted by an adult, it cannot always be prevented that the drink is spilled due to unexpected movements of the child. In order to solve this problem, various types of devices for covering a drink container have been developed, which comprise a housing and a spout, for example, which projects from the cover device and which has at least one drink opening at a free end thereof. When a child wants to drink, she takes the spout in her mouth and keeps the drink container in a tilted position, and as soon as she exerts a suction force on the spout, the drink flows into her mouth through the spout, in a well-controlled manner due to the limited size of the at least one drink opening. Furthermore, when a drink container which is provided with a cover device is held upside-down, or is shaken, for example, the extent to which the content of the drink container is spilled is limited due to the limited size of the at least one drink opening, or there is even no situation of spillage at all, namely when the cover device is equipped with a valve arrangement which is normally closed, and which is adapted to be opened under the influence of a suction force as exerted through the at least one drink opening.

In a cover device which is equipped with a valve arrangement as mentioned, the valve arrangement may be positioned inside the spout or at an appropriate position inside the housing, behind the spout. In any case, the valve arrangement needs to be designed in such a way that a normal suction force as can be exerted by a small child is sufficient for putting the valve arrangement to an open state. On the other hand, the valve arrangement should not open too easily in order to avoid spillage when the drink container which is provided with the cover device is held upside down, or is shaken, for example. The fact is that in such cases, the valve arrangement is subjected to a force which is directed from inside the drink container to outside the drink container, which is the same direction as the direction of a suction force as exerted through the at least one drink opening. Therefore, in prior art solutions, the design of a valve arrangement is based on a compromise between a drinking situation and a situation in which pressure is prevailing inside the drink container. As a result, a child is compelled to exert a rather high suction force, or a leakproof cover device cannot be guaranteed.

U.S. Pat. No. 4,135,513 discloses a nozzle to be inserted in the opening of a nursing bottle or similar container, and which allows drinking by suction but prevents leaking when the bottle is left in any position. In particular, the drinking nozzle consists of an inner, hollow, substantially cylindrical member intended for being introduced in a tightening manner into an opening of a drink container, and an outer nozzle connected with said member protruding from the container opening. Between the cylindrical member and the nozzle, there is a valve seat, the valve body of which is located at a side of the valve seat turned towards the nozzle and is connected with one end of a shaft introduced through the valve seat. The other end of the shaft is connected with a membrane which along its periphery is fixed to the inner end of the cylindrical member. In that way, it is realized that the membrane together with a cover arranged outside the inner end of the cylindrical member define a space which through a bore in the cylindrical member is in connection with the atmosphere. Furthermore, the cylindrical member is provided with openings which connect the interior of the container with the space which is defined by the inner wall of the cylinder, the valve seat, the valve body and the membrane, and the outer end of the cylindrical member above the openings as mentioned is tight-fittingly connected with the free edge of the container opening. Advantageously, the membrane is fixed to the shaft of the valve body under a pre-stress so that the membrane keeps the valve body against the valve seat with a certain pressure.

In use of the nozzle, when by suction there is created an underpressure in the space defined by the nozzle, the valve seat and the valve body, the valve body will be lifted from the seat so that the liquid contained in the space will flow out through the valve seat. The underpressure will eventually be balanced by the valve letting in air after the user removed the nozzle from the mouth.

The tightening obtained between the valve body and the valve seat by means of the pre-stress of the membrane is sufficient for preventing the liquid from flowing out from the container through the valve when the container is placed on the side. When the container is turned upside down and is shaken or pressed together, there are, however, greater forces which act, and the tightening force caused by the pre-stress of the membrane is, in that case, relatively insignificant. The pressure arising in the space when the container is put under pressure will act with a force on the membrane in the direction away from the valve seat, so that the valve body is pressed against the valve seat with a force which increases proportionally with the pressure in the space, as a result of which it is not possible for liquid to flow out of the container.

US 2003/037820 discloses various types of valves for use in conjunction with fluid containers or tubing. Among other things, a tubing having a valve member which includes a diaphragm is described. The valve member also includes a port and a plunger. The diaphragm is responsive to an external force supplied by a user, and a movement of the diaphragm in response to the external force places the valve member in an open condition. The plunger has a first end joined to the diaphragm and a second end extending from the lower surface of the diaphragm. The second end of the plunger substantially plugs the port when the valve member is in a closed condition.

In another embodiment of the valve, the valve member comprises a duckbill mechanism. The valve member of this embodiment may be placed in the open condition either via a vacuum pressure or a positive pressure exerted on the sidewall of the tubing. In particular, the valve member comprises a pore member having a central portion which dilates when the valve member is in the open condition. The central portion is at least substantially sealed in the closed condition and responsive to an external force provided by a user wherein the dilating central portion expands to allow a flow of fluid substance to pass therethrough. The central portion includes an inwardly tapered, flexible duckbill. This duckbill has a hinge portion joined to the sidewall of the tubing and a separable slit which is at least substantially sealed when the valve member is in the closed condition. The valve member is responsive to a deflection in the sidewall to open the valve member. To operate the valve member by a vacuum pressure, a user applies a vacuum pressure to a distal end of the tubing. As a result, the sidewalls of the tubing are caused to collapse to some extent, whereby the slit is opened to allow for a flow of fluid.

GB 2 333 770 discloses a closure assembly for a drinking vessel such as a trainer cup, which comprises a lid with a drinking spout extending therefrom. Furthermore, a diaphragm is mounted on the lid, which has a sealing portion for cooperating with a valve seat in order to prevent liquid flow through the spout, and another sealing portion for covering a breather hole. When a user sucks on the spout, the sealing portions are deflected to allow liquid flow through the spout and air flow through the breather hole. In a number of embodiments, the latter sealing portion is an annular lateral flap of the diaphragm, extending outwardly along a relatively small distance.

SUMMARY OF THE INVENTION

It is an object of the present invention to provide an improved cover device for a drink container. The invention is defined by the independent claims. Advantageous embodiments are defined in the dependent claims. In an embodiment, a valve arrangement is present which can easily be opened by a user exerting a vacuum force while being capable of realizing a leakproof seal of the drink container in case the valve arrangement is subjected to pressure at the container side thereof. An embodiment provides a cover device for a drink container, comprising a basic assembly which is provided with at least one drink opening, and a valve arrangement which is associated with the basic assembly, which is adapted to assume various states for determining an extent to which a passage to the drink opening in the basic assembly from a side of the cover device which is intended to face the drink container is blocked, wherein the valve arrangement comprises an element which is hingably associated with a supporting surface portion of the basic assembly, wherein the valve element has two portions which are connected to each other through an area of the valve element which is present at a position where the valve element is hingably associated with the supporting surface portion of the basic assembly, and wherein only one of the two portions of the valve element is in direct communication with the drink opening of the basic assembly.

The cover device according to the present invention comprises a basic assembly, which may include a housing and a spout which projects from the housing, wherein it is noted that other embodiments of the basic assembly are feasible within the framework of the present invention as well. The valve arrangement of the cover device according to the present invention comprises a valve element, which may be a flexible element such as a silicone membrane, or a silicone ring, for example. The valve element may be arranged such as to be hingably associated with a surface portion of the basic assembly of the cover device, particularly to hingably contact or to be hingably connected to the surface portion as mentioned. In practice, in case the hinge association is a hinge contact, the hinge contact may be realized in any suitable way, ranging from a case in which the surface portion of the basic assembly is flat and in which the valve element comprises a V-shaped portion and/or is provided with a protruding portion for contacting the flat surface portion to a case in which the valve element has a flat surface portion facing the surface portion of the basic assembly and in which the surface portion of the basic assembly is V-shaped and/or is a protruding portion for contacting the flat surface portion of the valve element.

The hinge association may be present at such a position with respect to the valve element that two portions of the valve element are discernable, wherein the portions are interconnected through an area which is present at the very position of the hinge association between the valve element and the surface portion of the basic assembly. The fact that there is a hinge association between the valve element and a surface portion of the basic assembly contributes to a capability of the valve element to assume various orientations to some extent. In case the valve element has flexible properties, the valve element is furthermore capable of deforming. The changes of appearance of the valve element in the cover device may be used for closing and opening a passage in the cover device to the drink opening. It will be understood that in the context of the cover device, deformations and/or changes of orientation are supposed to take place under the influence of pressures, in particularly a pressure relating to a situation in which a user exerts a suction force through the drink opening on the one hand and a pressure acting in the same direction on the valve arrangement, but from another side, namely a side which serves for facing an interior of the drink container.

For sake of completeness, it is noted that a drink container can be a cup or a bottle or the like, which is closed except for an opening through which the container can be filled with a liquid and through which liquid can be discharged from the container again. However, it is also an option to provide the drink container with an opening through which the container can be filled with a liquid and an opening through which liquid can be discharged from the container again. The cover device is designed for performing a function of covering the drink container at the location of the opening as mentioned.

If only one of the two portions of the valve element is in direct communication with the drink opening, wherein the hinge association between the valve element and a surface portion of the basic assembly may have a function in blocking possible communication between the other portion of the valve element and the drink opening, it is achieved that when a user exerts a suction force through the drink opening, only the one portion is addressed. As a result, this portion is made to deform and/or tilt. This effect is suitable to be applied for causing the valve arrangement to open. For sake of clarity, the portion of the valve element as mentioned will be referred to as primary portion, whereas the other portion of the valve element, i.e. the portion which is not under the direct influence of the drink opening, will be referred to as secondary portion.

As the primary portion is connected to the secondary portion, the hinging movement of the primary portion may cause a hinging movement of the secondary portion, wherein the extent to which the secondary portion is deformed and/or tilted is dependent on the extent to which the valve element is flexible, among other factors. Likewise, a pressure which is applied on the secondary portion causes the secondary portion to deform and/or tilt, wherein tensions prevailing in the secondary portion are partially transferred to the primary portion as well. The pressure can be a pressure as prevailing in an interior of a drink container which is provided with the cover device due to the fact that the drink container is shaken or knocked over, for example, while containing a liquid. The same pressure can also act on the primary portion, which has the effect of opening the primary portion unless the effect of the tensions as transmitted by the secondary portion is stronger and realizes a tendency of the primary portion to move in a direction which is opposite to an opening direction. This can be guaranteed by choosing appropriate design parameters of the cover device while taking into account a normal pressure range associated with a suction action of a user and a normal pressure range associated with interior pressures which can be expected in a drink container due to rough handling, respectively. In a practical embodiment, the primary portion may be smaller than the secondary portion. In such an embodiment, assuming that distances of the primary portion to a hinge area are not very much larger than distances of the secondary portion to the hinge area, when a pressure is acting on both the primary portion and the secondary portion, the hinging effect of the secondary portion on the primary portion can always be significantly larger than the tendency of the primary portion to move in a direction which would cause the valve arrangement to open.

In particular, it is preferred for sizing, positioning and orientation of the two portions of the valve element to be realized for having a smaller total moment of force on the portion of the element which is in direct communication with the drink opening of the basic assembly than on the other portion of the element, i.e. the portion not being in direct communication with the drink opening, when the element is subjected to pressure from the side of the cover device which is intended to face the drink container. In this respect, it is noted that the total moment of force is found on the basis of the following equation: $M=\int_A r\times P\ n\ dA$, in which M represents the total moment of force, which is a vector, A represents an area of the valve element, wherein dA is a discrete portion of the area of the valve element, r represents a vector from a given hinge point to a centre of the portion of the area, and P n represents the pressure as resulting in a force perpendicular to the portion of the area. Thus, the equation may also be denoted as $M=\int_A r\times F$, wherein F represents a force vector. The moment about a line through a given point can be found by taking the inner product of the moment vector and a unit vector in the direction of the line: $M_{about\ line}=M\cdot e_{line}$, in which $e_{line}$ represents a vector of unit length in the direction of the line.

Essential aspects of the calculation of the total moment of force include the following: the pressure works in all directions and gives a force perpendicular to a surface area; the moment depends on the force, the distance from the hinge point, and the direction of both the force and the vector r; the result is a vector M, which can be projected onto a line to give the moment about the line. In this procedure, the vector M is calculated first and the result is reduced to a moment about a line using the inner product. Alternatively, the contribution of each portion of the area to the moment about the line could be calculated before the integration.

In a practical embodiment of the cover device according to the present invention, the primary portion of the valve element comprises an area for contacting a surface portion of the basic assembly, which is another surface portion of the basic assembly than the surface portion which is involved in the hinge association of the valve element, wherein the closed state of the valve arrangement is associated with a situation in which the area is made to contact the relevant surface portion of the basic assembly, and wherein the open state of the valve arrangement is associated with a situation in which the area is at a distance from the relevant surface portion. Hence, in such an embodiment, a closed state of the valve arrangement is based on closing contact between the valve element and a surface portion of the basic assembly at an appropriate position for blocking a passage to the drink opening. Advantageously, when considering the application of the cover device with a drink container, the designs of the valve element and the basic assembly are aimed at having the closing contact when the valve element is in a default position, which is a rest position in a situation in which there is no underpressure or overpressure, allowing for an opening when underpressure is prevailing as a result of suction forces exerted through the drink opening, and intensifying the closing contact through a lever action of the secondary portion of the valve element on the primary portion of the valve element when overpressure is prevailing in the drink container.

In another practical embodiment of the cover device according to the present invention, the primary portion of the valve element is provided with a slit, wherein the closed state of the valve arrangement is associated with a situation in which the slit is allowed to be closed, and wherein the open state of the valve arrangement is associated with a situation in which the slit is opened. Advantageously, when considering the application of the cover device with a drink container, the design of the valve element is aimed at having a closed condition of the slit when the valve element is in a default position, allowing for the slit to be opened when underpressure is prevailing as a result of suction forces exerted through the drink opening, and intensifying the closed condition of the slit through a lever action of the secondary portion of the valve element on the primary portion when overpressure is prevailing in the drink container. For example, the primary portion may be generally dome-shaped in a rest position of the valve element. In that case, it is possible to realize a lever action at a periphery of the dome which causes the dome to flatten. When expansion of the periphery of the dome is restricted at the same time, the primary portion is compressed, as a result of which the slit is closed tighter and tighter.

As mentioned in the foregoing, the valve element may be shaped like a membrane. In that case, one of the two portions of the valve element is a central portion of the element, and the other of the two portions of the valve element is a ring-shaped portion at a side of an outer periphery of the element, surrounding the central portion. The membrane may be suitable for use in the above-described embodiment of the cover device in which the closed state of the valve arrangement is based on closing contact between the valve element (membrane) and a surface portion of the basic assembly at an appropriate position for blocking a passage to the drink opening. This is particularly the case when the ring-shaped portion of the membrane is used as the primary portion, and the central portion is used as the secondary portion. However, it is also possible for the membrane to be suitable for use in the above-described embodiment of the cover device in which the closed state of the valve arrangement is based on a closed condition of a slit as provided in the primary portion of the valve member (membrane). This is particularly the case when the central portion of the membrane is used as the primary portion, wherein the primary portion may be generally dome-shaped as explained earlier, and the ring-shaped portion is used as the secondary portion.

The valve element may be provided with a valve for allowing air to pass from one side of the element to the other. The valve may comprise a duckbill, for example. For example, in a situation in which the closed state of the valve arrangement is based on closing contact between a membrane and a surface portion of the basic assembly at an appropriate position for blocking a passage to the drink opening, and in which only a ring-shaped portion of the membrane is under the direct influence of the drink opening and thereby serves as the primary portion, the valve for allowing air to pass may be arranged in the secondary portion, which is a central portion of the membrane in that case. In a situation in which the cover device is in place on a drink container and underpressure is caused due to a suction action performed by a user through the drink opening, the valve opens so that the pressure can be normalized due to an aeration effect which is obtained in this way.

The valve element does not necessarily need to be provided in the form of a membrane. According to another option existing within the framework of the present invention, the valve element is shaped like a ring, wherein one of the two portions of the valve element is a ring-shaped portion at a side of an inner periphery of the element, and wherein the other of the two portions of the valve element is a ring-shaped portion at a side of an outer periphery of the element. A ring-shaped valve element is especially suitable to be used in case the closed state of the valve arrangement is based on closing contact between the valve element and a surface portion of the basic assembly at an appropriate position for blocking a passage to the drink opening, wherein one of the ring-shaped portions may comprise an area for actually making the contact and thereby serve as the primary portion.

Within the framework of the present invention, various options in respect of the exact constitution of the surface portion of the basic assembly with which the valve element is hingably associated exist. According to one option, the basic assembly comprises a housing and a spout, and the surface portion as mentioned is an end surface of the spout as present inside the housing. According to another option, an interior housing body which is shaped like a hollow cylinder is provided, wherein the surface portion as mentioned is an end surface of the body. According to yet another option, the surface portion as mentioned is a portion of an interior surface of a spout. This option is applicable in case the valve arrangement is positioned inside a spout.

In general, it is noted that in case the valve element has flexible properties, the valve element may include a number of strengthening ribs. For example, when the valve element comprises silicone as mentioned earlier, the strengthening ribs may support the lever action of the secondary portion on the primary portion which is supposed to take place when overpressure is prevailing in a drink container as covered by the cover device.

Preferably, the cover device is provided in combination with a drink container, wherein both the cover device and the drink container are adapted in such a way as to be attachable to each other and detachable from each other. To that end, both the cover device and the drink container may be provided with screw thread, for example.

The above-described and other aspects of the present invention will be apparent from and elucidated with reference to the following detailed description of a number of embodiments of a cover device for a drink container.

BRIEF DESCRIPTION OF THE DRAWINGS

The present invention will now be explained in greater detail with reference to the figures, in which equal or similar parts are indicated by the same reference signs, and in which:

FIG. 13 shows a perspective view of a valve arrangement of a cover device according to a fourth embodiment of the present invention;

FIG. 14 shows a sectional view of the valve arrangement as taken in a vertical direction along a line A-A in FIG. 13, wherein furthermore a spout and a portion of a housing of the cover device according to the fourth embodiment of the present invention are shown.

DETAILED DESCRIPTION OF EMBODIMENTS

Figure 1:
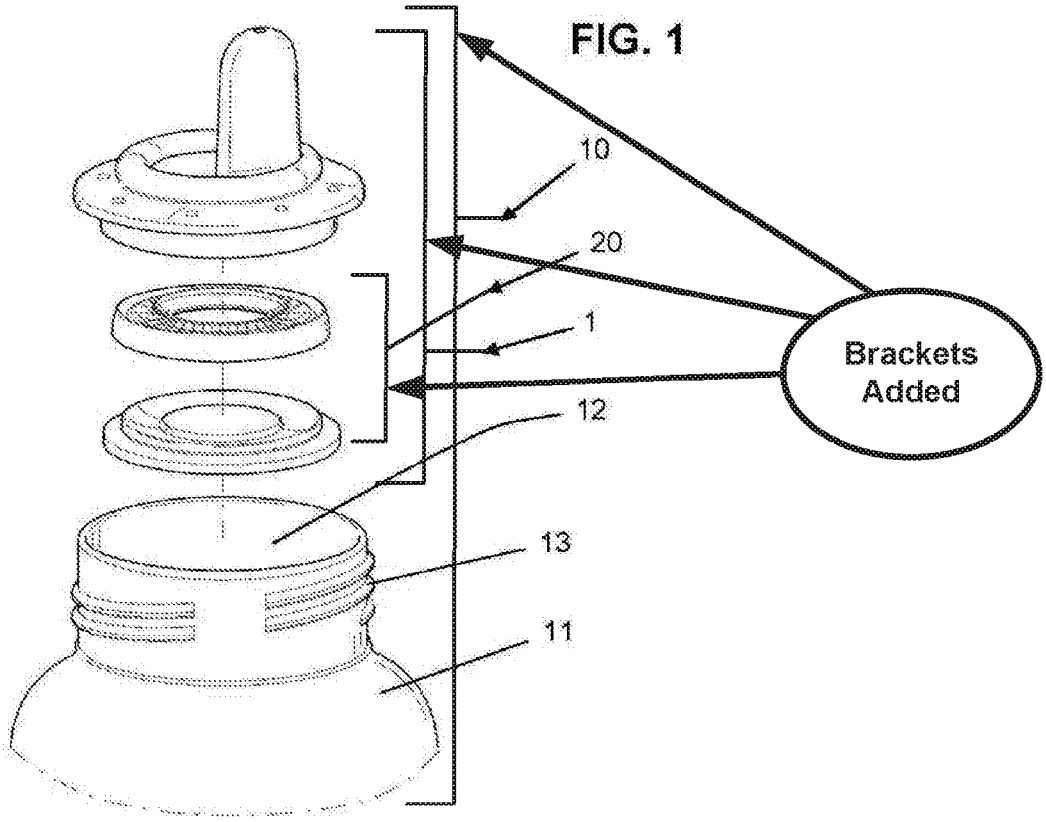
FIG. 1 shows an exploded view of a top portion of a drink bottle and a cover device according to a first embodiment of the present invention.
Figure 2:
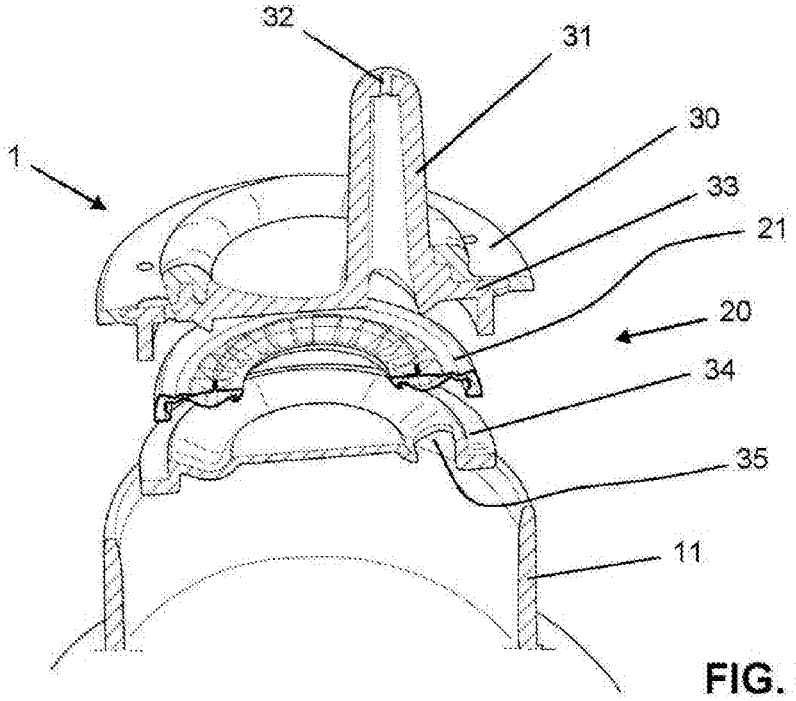
FIG. 2 shows an exploded sectional view of the top portion of the drink bottle and the cover device according to the first embodiment of the present invention.

FIGS. 1-5 relate to a cover device 1 according to a first embodiment of the present invention. In general, the cover device 1 is intended to be used for covering an open side 12 of a drink container such as a drink bottle 11, wherein the cover device 1 has a function in avoiding spillage of liquid from the drink bottle 11. However, the cover device 1 is not just a cover having a sealing function. Instead, the cover device 1 comprises a valve arrangement 20 which is adapted to prevent liquid from flowing from an interior of the drink bottle 11 to outside of the drink bottle 11 through the cover device 1 in a closed state, and to allow a flow of liquid to pass through in an open state. In this way, it is possible to allow a user of an assembly 10 of the cover device 1 and the drink bottle 11 to drink from the drink bottle 11 if so desired without a need of removing the cover device 1, while the cover device 1 can perform a sealing function on the drink bottle 11 in all other circumstances.

The cover device 1 comprises a housing 30 and a spout 31 which projects from the housing 30, wherein the spout 31 comprises at least one drink opening 32 and is intended to be inserted into the mouth of the user. It is noted that an assembly of the housing 30 and the spout 31 is also referred to as basic assembly 9 of the cover device 1. When the user exerts a sucking force on the spout 31, an underpressure is obtained in the spout 31 as a result thereof, which causes the valve arrangement 20 to open and allow the drink to pass from the drink bottle 11 to the user's mouth, wherein it is assumed that the user keeps the drink bottle 11 in a tilted orientation so that the drink is present at the location of the cover device 1. The details of the valve arrangement 20 will be explained later.

Within the framework of the present invention, the cover device 1 and the drink bottle 11 can be provided with any suitable type of means for allowing the cover device 1 and the drink bottle 11 to be attached to each other or to be detached from each other, depending on the user's desires. For example, both the cover device 1 and the drink bottle 11 can be provided with screw thread, wherein the drink bottle 11 can be provided with external screw thread 13 as shown in FIG. 1, and wherein the housing 30 of the cover device 1 can have a ring-shaped member (not shown) which is provided with internal screw thread for engaging with the external screw thread 13 of the drink bottle 11.

Figure 3:
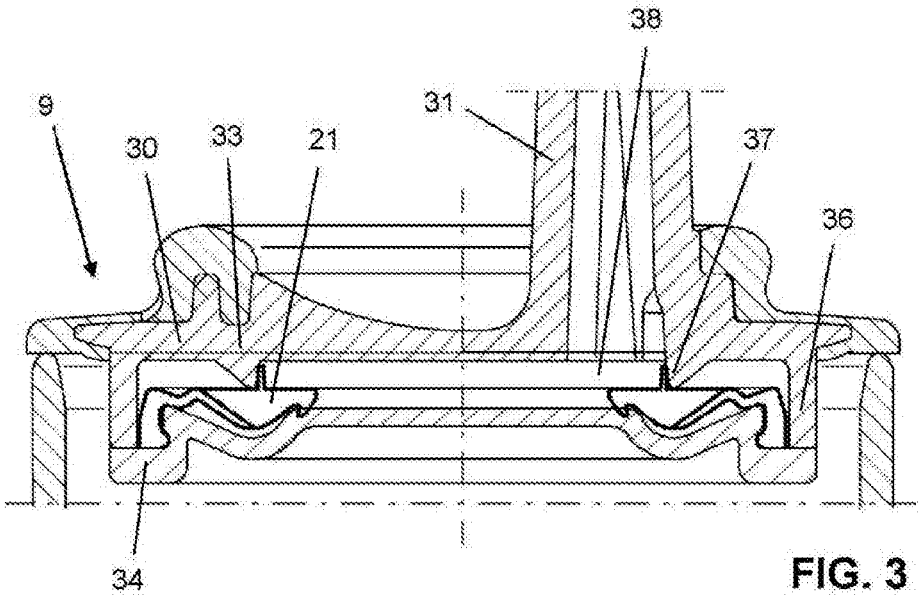
FIG. 3 shows a sectional view of the top portion of the drink bottle and the cover device according to the first embodiment of the present invention, in an assembled condition.

In the cover device 1 according to the first embodiment of the present invention, which will hereinafter be referred to as the first cover device 1, the housing 30 comprises two portions 33, 34, wherein the spout 31 is integrally formed with one of those portions 33, 34, which will therefore hereinafter be referred to as spout portion 33. The valve arrangement 20 of the first cover device 1 comprises a silicone valve ring 21 which is sandwiched between the two portions 33, 34 of the housing 30 as shown in FIG. 3. In view of this particular construction, the other portion 34 of the housing 30 will hereinafter be referred to as valve retainer 34.

The valve retainer 34 is provided with a hole 35 which is present at a location which corresponds to the location of the spout 31. In a rest position of the valve ring 21 as shown in FIG. 3, i.e. a position of the valve ring 21 which is related to a situation in which the valve ring 21 is not subjected to any pressure, the valve ring 21 blocks the way between the hole in the valve retainer 34 and the spout 31. Hence, when the valve ring 21 is in the rest position, liquid cannot pass from the drink bottle 11 to the spout 31, so that spillage is avoided. In particular, the valve ring 21 comprises a projecting edge portion 22 at an inner periphery thereof, which is adapted to realize sealing contact to a surface portion of the valve retainer 34.

The spout portion 33 of the housing 30 comprises an outer ring-shaped member 36 for encompassing an outer periphery of the valve ring 21. Furthermore, the spout portion 33 is equipped with an inner ring-shaped member 37 which serves for locally supporting the valve ring 21 at a position between the inner periphery and the outer periphery of the valve ring 21. In particular, the inner ring-shaped member 37 contacts the valve ring 21 only through a small area, so that a hinge contact is realized. The various states of the valve arrangement 20 are realized on the basis of the fact that the valve ring 21 has flexible properties so that the valve ring 21 is deformable under the influence of pressure. In this respect, it is noted that the valve ring 21 does not necessarily need to comprise silicone, but may comprise any suitable material having flexible properties. Furthermore, the hinge contact between the valve ring 21 and a supporting surface portion of the spout portion 33 of the housing 30 allows for changes in the position/orientation of the valve ring 21 in the cover device 1 when pressure is exerted.

Figure 4:
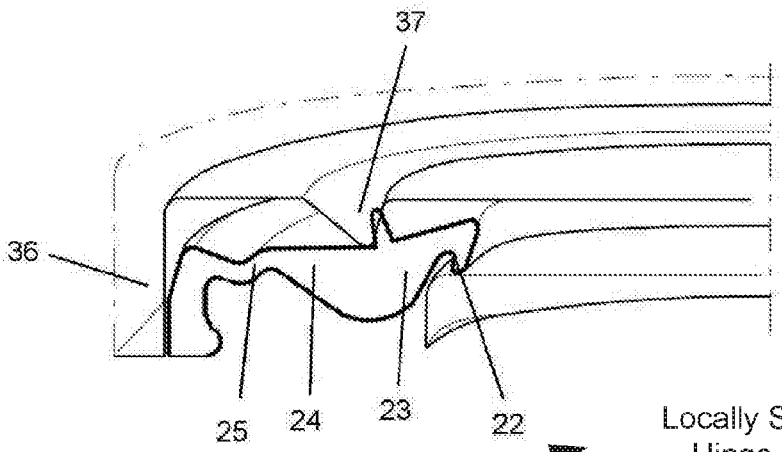
FIGS. 4 and 5 illustrate two different states of a valve arrangement of the cover device according to the first embodiment of the present invention.

The inner ring-shaped member 37 of the spout portion 33 of the housing 30 divides the valve ring 21 into two portions, as it were, namely an inner ring portion 23 and an outer ring portion 24. As can be seen in FIG. 3, the inner ring portion 23 is located in an interior space 38 of the housing 30 which is in direct communication with the spout 31, whereas the outer ring portion 24 is separated from that space 38 by the inner ring-shaped member 37. In other words, the inner ring portion 23 is in direct communication with the drink opening 32 of the spout 31, whereas the outer ring portion 24 is not. As a consequence, when the user exerts a suction force on the spout 31 and thereby creates an underpressure in the spout 31, only the inner ring portion 23 is under the influence of that underpressure, wherein the pressure difference across the inner ring portion 23 causes a deformation and a tilting movement of the valve ring 21, so that the edge portion 22 which present at the inner periphery of the valve ring 21 is pulled away from the valve retainer 34 and the sealing contact of the valve ring 21 to the valve retainer 34 is lost. At that point, the valve arrangement 20 is in the open state, which is illustrated in FIG. 4. In order to enhance the tilting effect of the inner ring portion 23, the outer ring portion 24 comprises a narrowed portion 25, so that a change of orientation of the inner ring portion 23 does not require much force.

Figure 5:
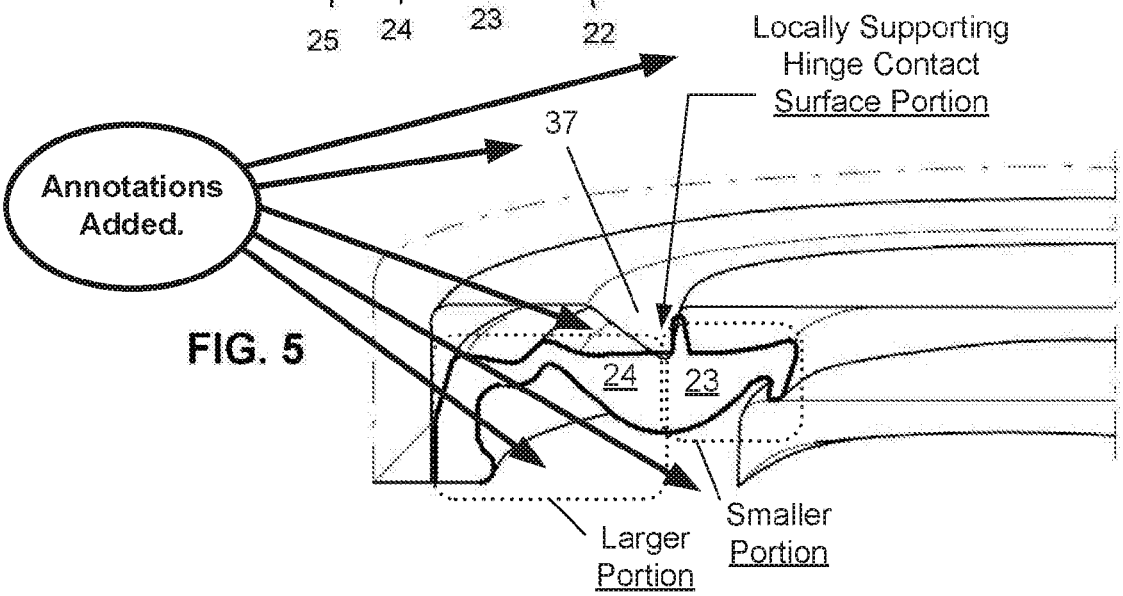

Another situation is obtained when overpressure is obtained inside the drink bottle 11, which may be the case when the drink bottle 11 is shaken or falls down, for example, in a situation in which the drink bottle 11 is filled to at least some extent. In the situation of overpressure as mentioned, a pressure difference is obtained across both the inner ring portion 23 and the outer ring portion 24 of the valve ring 21, as both ring portions 23, 24 are in communication with the interior of the drink bottle 11. The outer ring portion 24 is pressed in a direction of the spout portion 33 of the housing 30, and is deformed in such a way as to move in a space which is present between the outer ring-shaped member 36 and the inner ring-shaped member 37 of the spout portion 33. The inner ring portion 23 is under the influence of two factors, namely the pressure difference as mentioned and tensions which are a result of the deformation of the outer ring portion 24. The first factor tends to cause the inner ring portion 23 to assume a position in which the sealing contact to the valve retainer 34 is lost, whereas the second factor tends to cause the inner ring portion 23 to tilt and assume a position in which the sealing contact to the valve retainer 34 is intensified. The design of the valve ring 21 is chosen such that the second factor is the strongest factor, so that a closed state of the valve arrangement 20 is guaranteed in the situation of overpressure prevailing at the side of the cover device 1 facing the drink bottle 11. Among other things, a design factor contributing to the influence of the outer ring portion 24 on the inner ring portion 23 is the presence of a thickened portion in the valve ring 21 at the location of the hinge contact to the spout portion 33 of the housing 30, by means of which a lever effect of the outer ring portion 24 on the inner ring portion 23 is enhanced. FIG. 5 illustrates the appearance of the valve ring 21 in the situation of overpressure as described in the foregoing.

It follows from the above description of the first cover device 1 that the valve arrangement 20 only assumes an open state if underpressure is created inside the spout 31, in other words, if a user wants to drink and performs a suction action on the spout 31. Due to the fact that the valve ring 21 hingably contacts the spout portion 33 of the housing 30, wherein two ring portions 23, 24 can be discerned which are addressed differently in a situation of underpressure prevailing at the spout side and a situation of overpressure prevailing at the bottle side, it is possible for the valve arrangement 20 to act differently in the situations as mentioned, even though the pressure differences in these situations are generally the same in the sense that a lower pressure is prevailing at the spout side and a higher pressure is prevailing at the bottle side. Thus, according to the present invention, a cover device 1 is obtained which does not require a user to exert high suction forces for opening the valve arrangement 20 and thereby realizing an open passage for having a flow of liquid from a drink bottle 11 to the drink opening 32 of the spout 31, while still being leakproof, also in cases of overpressure prevailing inside the drink bottle 11. Moreover, in cases of overpressure, the closed state of the valve arrangement 20 is even intensified due to a clever design of the valve arrangement 20. In the case of the first cover device 1, this clever design involves the shape of the valve ring 21 as applied in the valve arrangement 20 and the positioning of the valve ring 21 inside the housing 30 of the cover device 1, wherein there is hinge contact between the valve ring 21 and the spout portion 33 of the housing 30.

For sake of completeness, it is noted that the design of the valve ring 21 may be adapted to the design of the space where the ring 21 is to be accommodated in such a way that during assembly of the first cover device 1, the inner periphery of the valve ring 21 is pushed in the direction of the spout portion 33 of the housing 30 by the valve retainer 34. In that way, it is ensured that tension is obtained in the valve ring 21 which causes the contact between the edge portion 22 at the inner periphery of the valve ring 21 and the valve retainer 34 to be an actual sealing contact.

Figure 6:
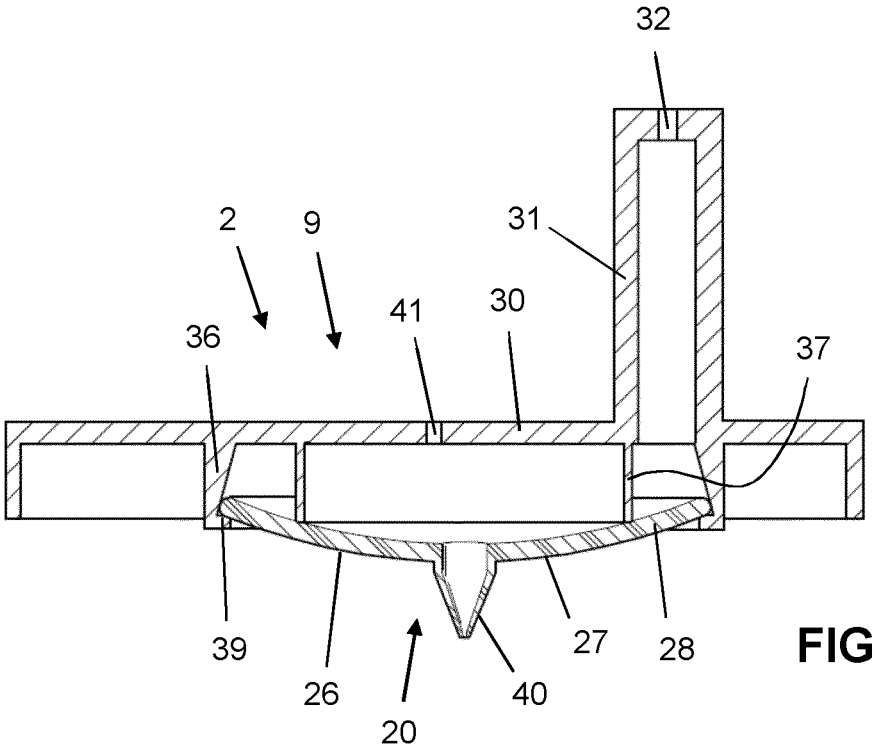
FIG. 6 shows a sectional view of a cover device according to a second embodiment of the present invention.

FIG. 6 relates to a cover device 2 according to a second embodiment of the present invention, which will hereinafter be referred to as the second cover device 2. Like the first cover device 1, the second cover device 2 comprises a basic assembly 9 including a housing 30 and a spout 31 which comprises at least one drink opening 32, and a valve arrangement 20. However, the housing 30 and the valve arrangement 20 of the second cover device 2 are of a different design than the housing 30 and the valve arrangement 20 of the first cover device 1, as will be explained in the following.

The valve arrangement 20 of the second cover device 2 comprises a valve membrane 26, which is made of a flexible material such as silicone as mentioned in the foregoing. In the shown example, the valve membrane 26 has a circular periphery. Furthermore, the housing 30 comprises only a portion which is comparable to the spout portion 33 of the first cover device 1. Like the spout portion 33 of the housing 30 of the first cover device 1, the housing 30 of the second cover device 2 comprises an outer ring-shaped member 36, wherein this ring-shaped member 36 serves for encompassing the periphery of the valve membrane 26, and wherein an end portion of this ring-shaped member 36 is provided with two inwardly projecting members 39 for retaining the valve membrane 26. In principle, on the basis of its flexible properties, the valve membrane 26 can be retained in the housing 30 only under the influence of tensions prevailing in the valve membrane 26. Still, it is preferred to have the inwardly projecting members 39 of the outer ring-shaped member 36 so that a situation in which the valve membrane 26 detaches from the housing 30 when, for example, the cover device 2 falls down and hits a surface, is avoided. Furthermore, like the spout portion 33 of the housing 30 of the first cover device 1, the housing 30 of the second cover device 2 comprises an inner ring-shaped member 37 for contacting the valve membrane 26 so that there is hinge contact between the valve membrane 26 and the inner ring-shaped member 37, wherein a central portion 27 of the valve membrane 26 and a ring-shaped portion 28 at a side of an outer periphery of the valve membrane 26, surrounding the central portion 27, can be discerned. In particular, the positioning and the diameters of the outer ring-shaped member 36 and the inner ring-shaped member 37 are chosen such that a ring-shaped space between the outer ring-shaped member 36 and the inner ring-shaped member 37 is in direct communication with the spout 31. Thus, it is achieved that only the outer ring-shaped portion 28 of the valve membrane 26 is under the direct influence of the spout 31, whereas the central portion 27 is not.

In the construction of the second cover device 2 as described in the foregoing, there is sealing contact between the outer periphery of the valve membrane 26 and a surface portion of the outer ring-shaped member 36 unless underpressure is created inside the spout 31. In such a situation, the outer ring-shaped portion 28 of the valve membrane 26 is pulled away from the outer ring-shaped member 36, wherein the sealing contact is lost. Thus, when a user puts the spout 31 in her mouth and exerts a suction force, free passage for liquid is obtained between the valve membrane 26 and the housing 30. The ring-shaped members 36, 37 of the housing 30 have a certain height so that it is avoided that the outer ring-shaped portion 28 of the valve membrane 26 blocks a base of the spout 31, i.e. an end of the spout 31 as present inside the housing 30, in the open state, so that an open passage is guaranteed. In a situation of overpressure at the bottle side, i.e. the side of the valve membrane 26 which faces away from the basic assembly 9, the entire valve membrane 26 is addressed instead of only the outer ring shaped-portion 28 thereof. As a result, the central portion 27 of the valve membrane 26 is made to flex in a direction towards the basic assembly 9, wherein the central portion 27 exerts a lever action on the outer ring-shaped portion 28, which counterweighs an inclination of the outer ring-shaped portion 28 to move in a direction towards the spout 31 and thereby realize the open state of the valve arrangement 20. Instead, under the influence of the stronger lever action, the outer ring-shaped portion 28 is pressed in an opposite direction, so that sealing contact between the outer periphery of the valve membrane 26 and the housing 30 is intensified.

As shown in FIG. 6, the valve membrane 26 may be provided with a valve such as a duckbill 40 which is arranged at the central portion 27 of the valve membrane 26 in order to realize aeration during a drinking action, thereby facilitating the drinking action and avoided a need for high suction forces. Naturally, in that case, the housing 30 is provided with at least one opening 41 for allowing air to be drawn into the space which is present between the inner ring-shaped member 37, the base of the inner ring-shaped member 37 and the central portion 27 of the valve membrane 26.

FIGS. 7-12 relate to a cover device 3 according to a third embodiment of the present invention, which will hereinafter be referred to as the third cover device 3. Like the first cover device 1 and the second cover device 2, the third cover device 3 comprises a basic assembly 9 including a housing 30 and a spout 31 which comprises at least one drink opening 32, and a valve arrangement 20. Like the second cover device 2, the third cover device 3 comprises a valve membrane 26. However, in this case, the closed state of the valve arrangement 20 is not obtained on the basis of sealing contact of a portion of the valve membrane 26 to a portion of the housing 30. Instead, the valve membrane 26 is provided with a slit 42.

Figure 7:
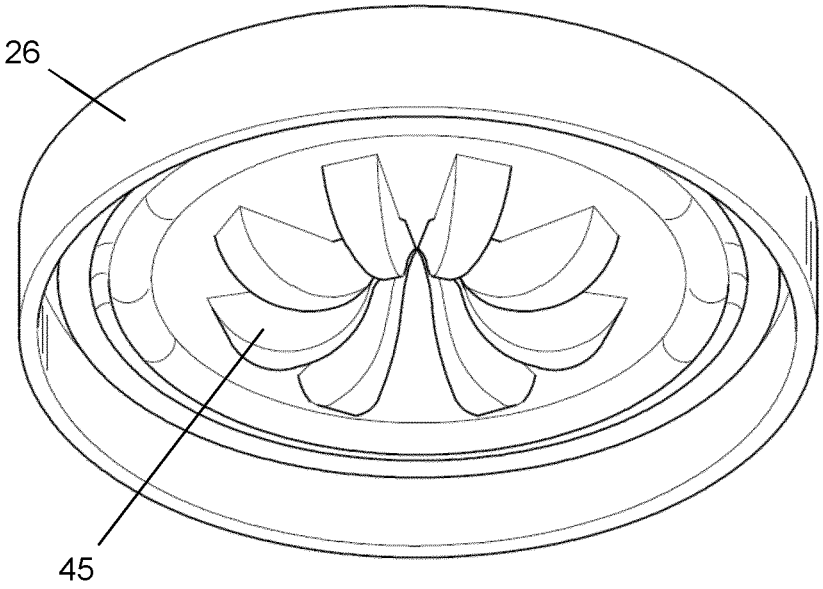
FIGS. 7 and 8 show perspective views of a membrane of a cover device according to a third embodiment of the present invention.
Figure 8:
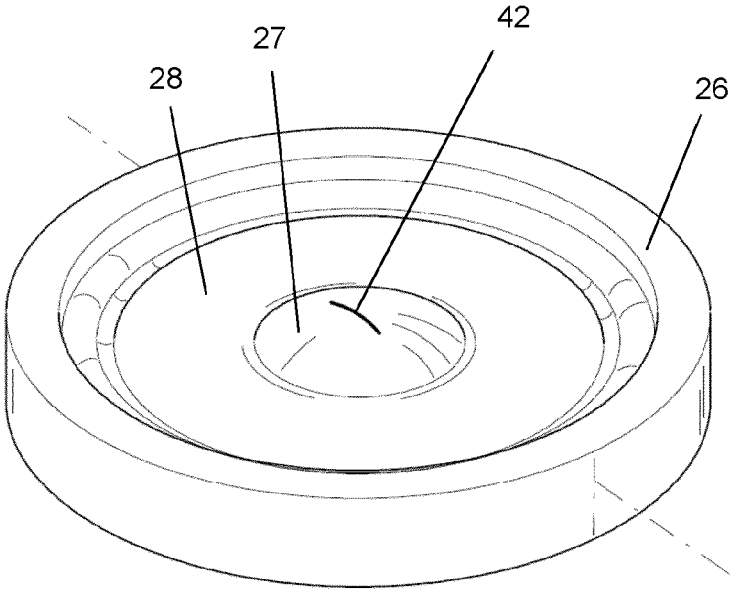
Figure 9:
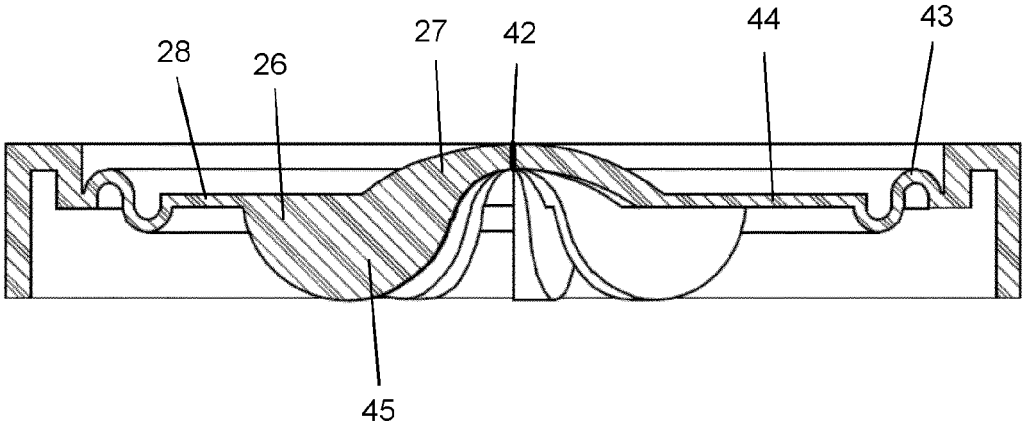
FIG. 9 shows a sectional view of the membrane.
Figure 10:
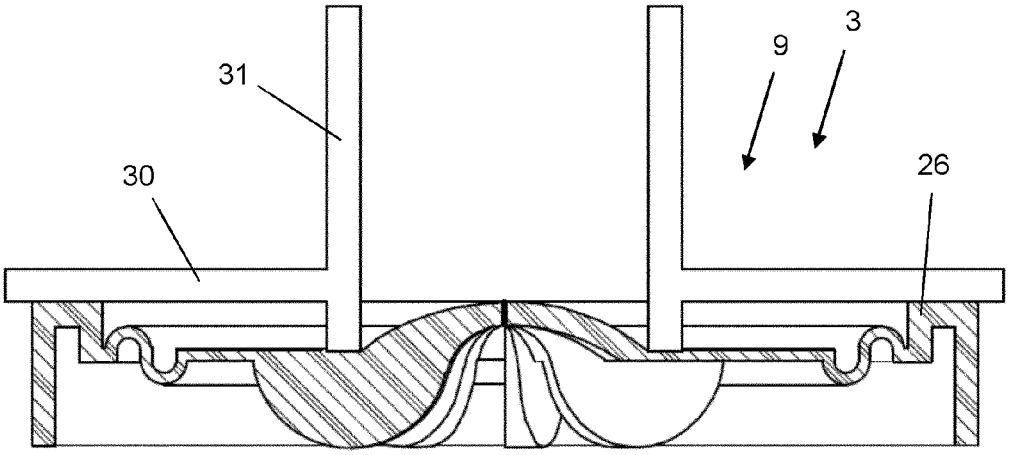
FIG. 10 illustrates how the membrane is positioned in the cover device according to the third embodiment of the present invention, wherein a portion of a spout and a portion of a housing of the cover device are diagrammatically shown.

In the shown example, the slit 42 is present in a dome-shaped, central portion 27 of the valve membrane 26. The valve membrane 26 is arranged at the base of the spout 31, wherein the diameter of the central portion 27 is adapted to the inner diameter of the spout 31 such as to be practically the same. Thus, it is achieved that the central portion 27 having the slit 42 is in direct communication with the drink opening 32 of the spout 31, whereas the outer ring-shaped portion 28 is not, as communication between the latter portion 28 and the drink opening 32 is blocked at a location where the valve membrane 26 hingably contacts the base of the spout 31, which is the location where the distinction between the central portion 27 and the outer ring-shaped portion 28 is made. In the third embodiment 3 the base of the spout 31 functions as the hinge of the hingable contact. However it may be clear that the hinge may also be part of the valve membrane 26. FIGS. 7-9 show views of the valve membrane 26. FIG. 10 illustrates how the valve membrane 26 is positioned with respect to the spout 31, and shows that the dome-shaped central portion 27 of the valve membrane 26 is present inside the spout 31 at the base of the spout 31. For sake of completeness, it is noted that the valve membrane 26 may be retained inside the third cover device 3 in any suitable manner, for example through a connection to the housing 30 at a position close to its outer periphery, or by means of a separate retainer as is the case in the first cover device 1.

Figure 11:
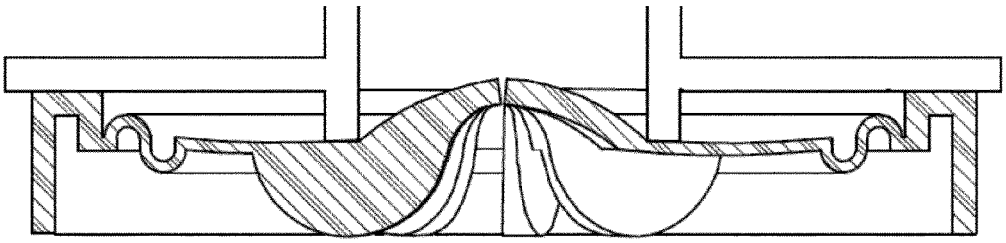
FIGS. 11 and 12 illustrate two different appearances of the membrane in the cover device according to the third embodiment of the present invention.

When the spout 31 is subjected to a suction action and underpressure is prevailing in the spout 31 as a result thereof, a pressure difference is obtained across the valve membrane 26, which acts on the central portion 27 of the valve membrane 26. As a result, the central portion 27 is deformed as it is pulled further into the spout 31 to some extent, wherein the slit 42 automatically opens in view of the fact that portions surrounding the slit 42 are pulled apart, as it were. The open state of the valve arrangement 20 which is thus obtained is illustrated in FIG. 11. In this state, there is an open passage from one side of the valve membrane 26 to another, so that liquid may pass from the bottle side of the valve membrane 26 to the spout side.

Figure 12:
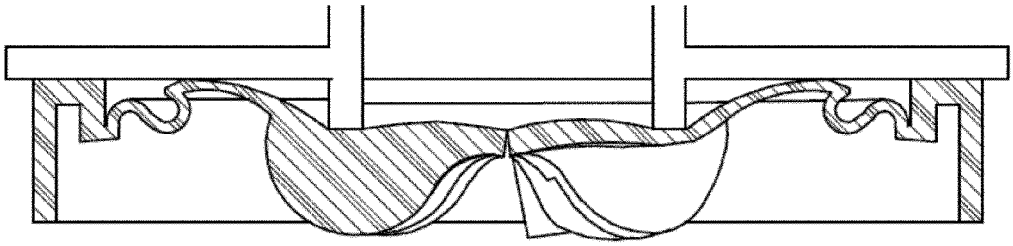

In a rest position of the valve membrane 26 in the third cover device 3, the slit 42 is closed. In a situation of overpressure at the bottle side of the valve membrane 26, the slit 42 is closed as well, wherein an extra tight closure is realized under the influence of tensions prevailing in the valve membrane 26. In particular, in such a situation, a pressure difference is prevailing across the entire valve membrane 26, i.e. across both the central portion 27 and the outer ring-shaped portion 28. Under the influence of this pressure difference, the outer ring-shaped portion 28 is deformed to a considerable extent. The base of the spout 31 projects inside the housing 30 along a certain distance, and the outer ring-shaped portion 28 is pressed in a direction towards the basic assembly 9, thereby moving in a space which is present between the outer ring-shaped portion 28 and the housing 30 due to the projecting arrangement of the spout 31. The outer ring-shaped portion 28 may be provided with a corrugated portion 43 as is the case in the shown example, for locally weakening the outer ring-shaped portion 28 and guaranteeing a tilting movement of a portion 44 of the outer ring-shaped portion 28 as present between the corrugated portion 43 and the contact between the base of the spout 31 and the valve membrane 26. The tilting movement is continued in the central portion 27 of the valve membrane 26, wherein portions delimiting the slit 42 are tilted and deformed, as a result of which the central portion 27 is flattened as illustrated in FIG. 12. As a result, the slit 42 is firmly closed, and a sealing function of the valve arrangement 20 as desired in the situation of overpressure is realized. Preferably, the valve membrane 26 includes a number of strengthening ribs 45 as is the case in the shown example, so that the lever action of the outer ring-shaped portion 28 on the central portion 27 may be guaranteed despite of the flexibility of the valve membrane 26. The number of strengthening ribs 45 may vary dependent on for example the thickness of the valve membrane 26, the length in radial length and the width in tangential direction of the strengthening ribs. It is the objective of the strengthening ribs 45 to support the lever action of the secondary portion 28 on the primary portion 27 which is supposed to take place when overpressure is prevailing in a drink container 11 as covered by the cover device 3.

Figure 15:
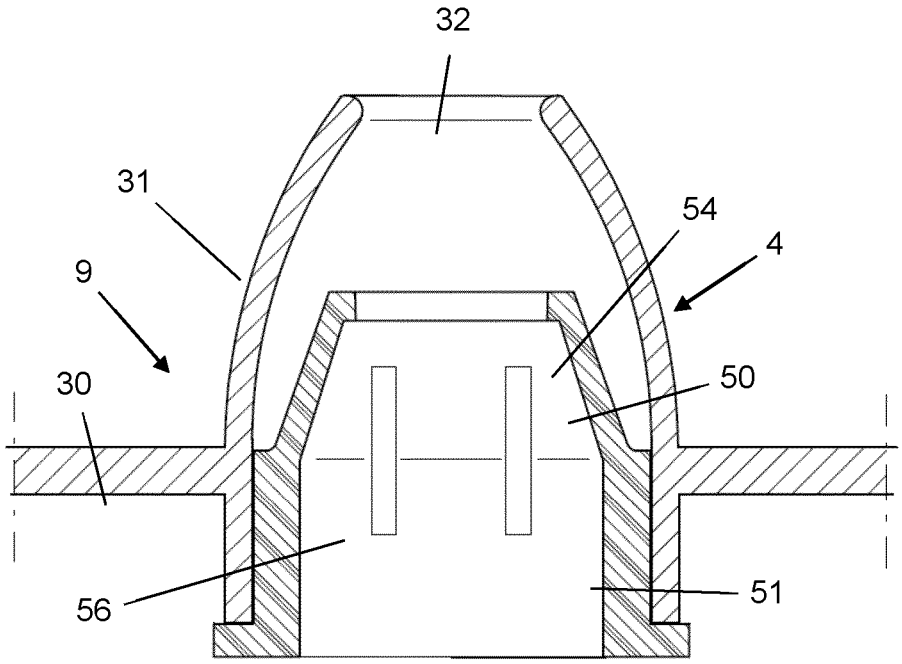
FIG. 15 shows a sectional view of the valve arrangement as taken in a vertical direction along a line B-B in FIG. 13, wherein furthermore the spout and a portion of the housing of the cover device according to the fourth embodiment of the present invention are shown.

FIGS. 13-15 relate to a cover device 4 according to a fourth embodiment of the present invention, which will hereinafter be referred to as the fourth cover device 4. When the fourth cover device 4 is compared to the cover devices 1, 2, 3 as described in the foregoing, a notable difference resides in the fact that the valve arrangement 20 is positioned inside the spout 31. In particular, the valve arrangement 20 comprises a valve element 50 which may be denoted as being a combination of a duckbill and the valve membrane 26 of the third cover device 3, wherein a base portion 51 of the valve element 50 comprises portions 52, 53 which are bulged towards each other, which portions are comparable to the outer ring-shaped portion 28 of the valve membrane 26 of the third cover device 3, and wherein a top portion 54 of the valve element 50, which is comparable to the central portion 27 of the valve membrane 26 of the third cover device 3, has a tapered cross-section and is provided with a slit 55. At transition areas between the top portion 54 and the inwardly bulged portions 52, 53 of the base portion 51, the valve element 50 hingably contacts a portion of the interior surface of the spout 31.

FIG. 13 shows a perspective view of the valve element 50. FIGS. 14 and 15 illustrate how the valve element 50 is positioned inside the spout 31, wherein the hinge contact between the valve element 50 and the spout 31 as mentioned in the foregoing can clearly be seen in FIG. 14. FIGS. 14 and 15 furthermore illustrate the fact that like in the valve membrane 26 as applied in the third cover device 3, strengthening ribs 56 are provided, covering interconnected portions of the top portion 54 and the inwardly bulged portions 52, 53 of the base portion 51 in order to enhance a lever action of the inwardly bulged portions 52, 53 which takes place in a situation of overpressure at the bottle side of the valve element 50.

In a rest position of the valve element 50, the slit 55 is closed. When underpressure is prevailing at the side of the valve element 50 facing the drink opening 32 of the spout 31, a resulting force is obtained which acts on the top portion 54 for opening the slit 55. When overpressure is prevailing at the bottle side of the valve element 50, the inwardly bulged portions 52, 53 of the base portion 51 are pressed apart, as a result of which tensions are transferred to the top portion 54 which cause the slit 55 to be more firmly closed by being sufficiently strong for counteracting an inclination of the top portion 54 to assume the open state under the influence of the pressure difference.

Figure 16:
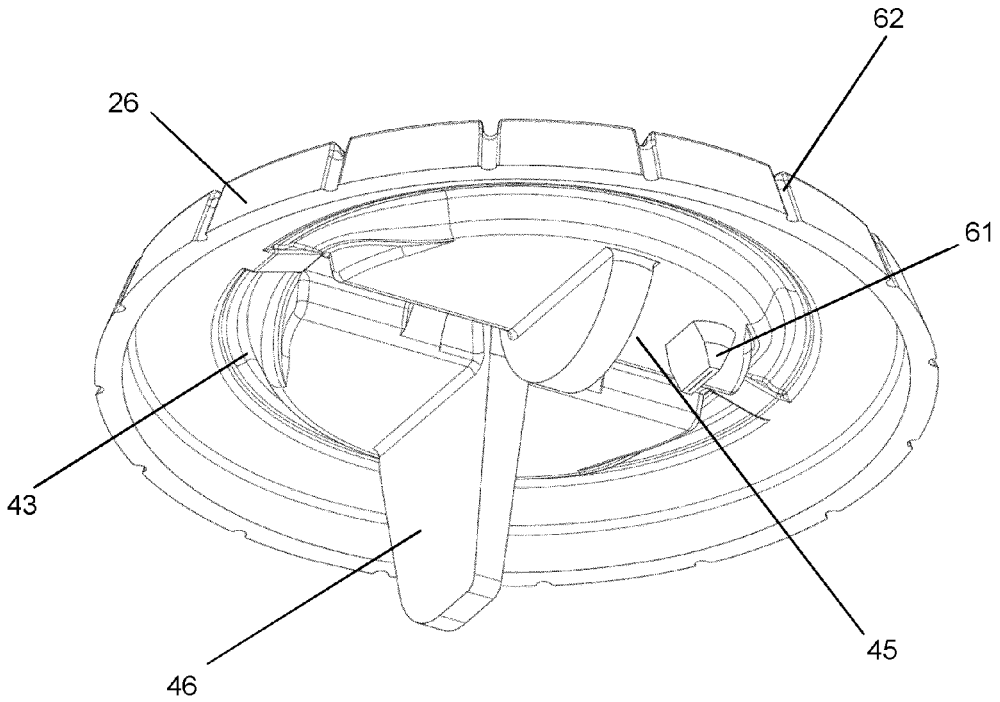
FIGS. 16 and 17 show perspective views of a membrane of a cover device according to a fifth embodiment of the present invention.
Figure 17:
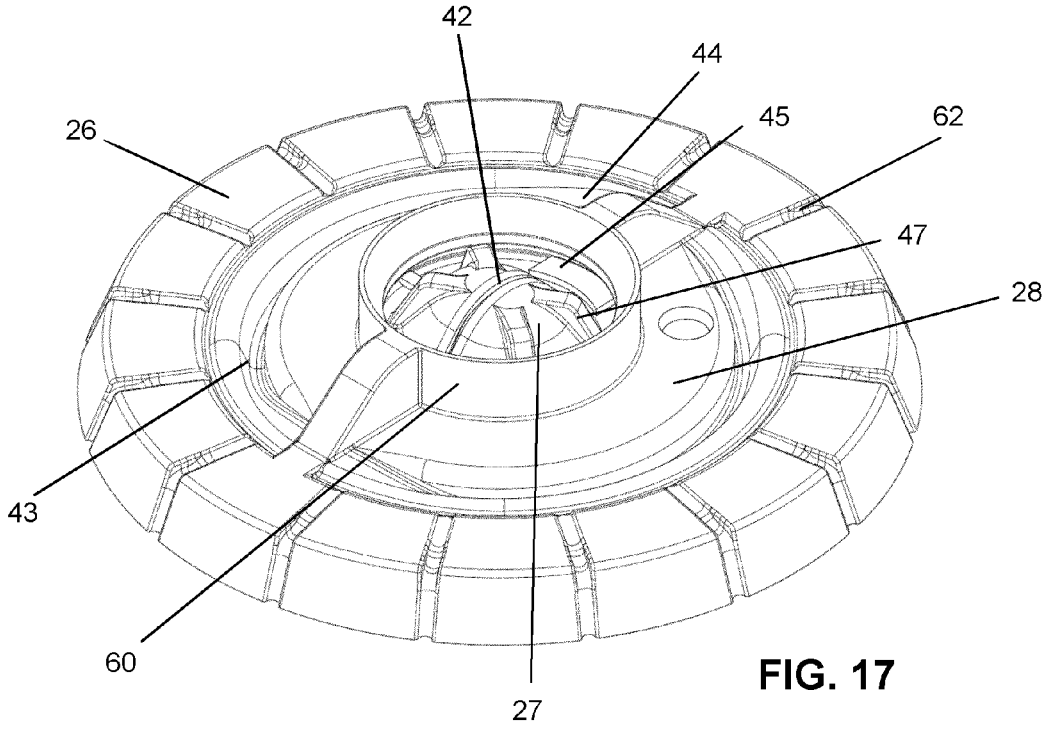
Figure 18:
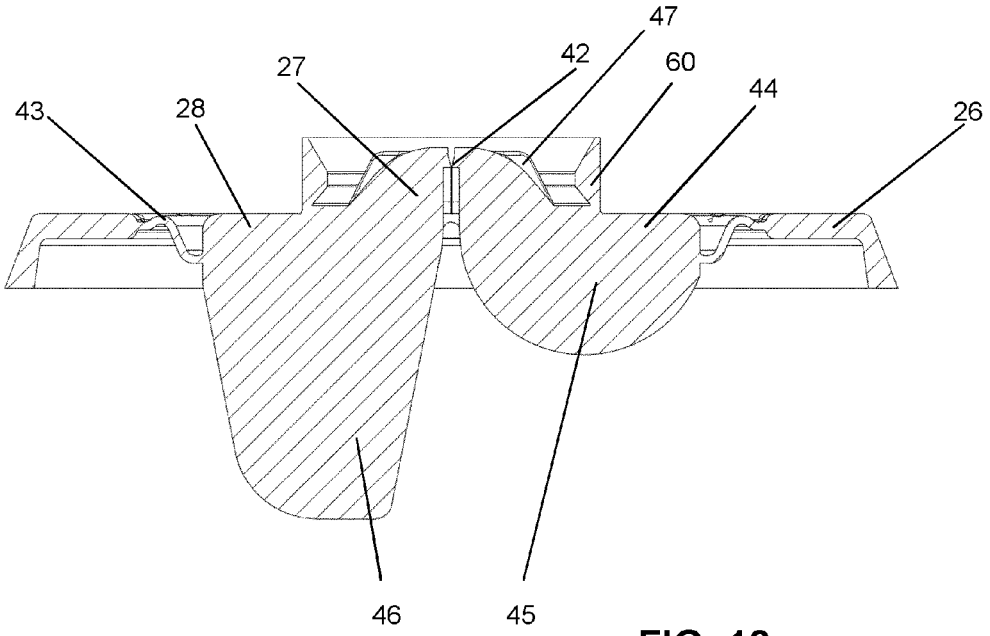
FIG. 18 shows a sectional view of a cover device according to the fifth embodiment of the present invention.
Figure 19:
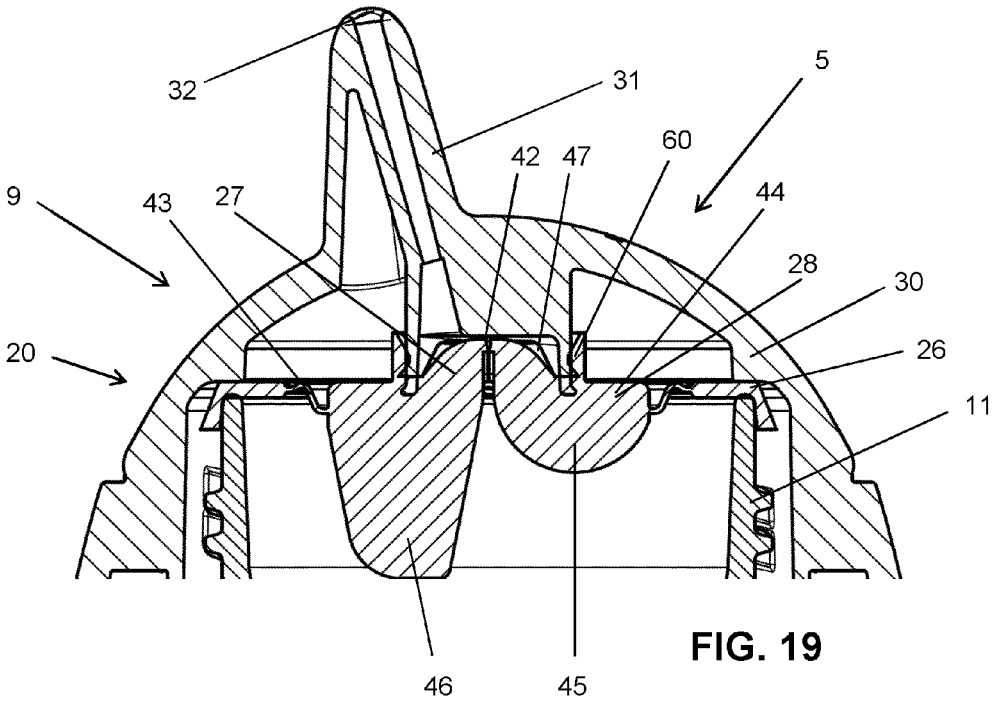
FIG. 19 illustrates how the membrane is positioned in the cover device according to the fifth embodiment of the present invention, wherein a spout and a housing of the cover device are diagrammatically shown.

FIGS. 16-19 relate to a cover device 5 according to a fifth embodiment of the present invention, which will hereinafter be referred to as the fifth cover device 5. FIG. 16 shows a bottom perspective view, FIG. 17 shows a top perspective view and FIG. 18 shows a cross-sectional view of the valve membrane 26 according to a fifth embodiment of the present invention. FIG. 19 illustrates how the valve membrane 26 is positioned in the cover device according to the fifth embodiment of the present invention.

Like the first cover device 1, the second cover device 2, the third cover device 3 and the fourth cover device 4, the fifth cover device 5 comprises a basic assembly 9 including a housing 30 and a spout 31 which comprises at least one drink opening 32, and a valve arrangement 20. Like the second cover device 2 and the third cover device 3, the fifth cover device 5 comprises a valve membrane 26. The valve membrane 26 is arranged at the base of the spout 31, wherein the diameter of the central portion 27 is adapted to the inner diameter of the spout 31 such as to be practically the same.

Similarly to the third cover device 3, the closed state of the valve arrangement 20 is obtained on the basis of sealing contact of the two sides of a slit 42 provided in the valve membrane 26. The slit 42 is present in a dome-shaped, central portion 27 of the valve membrane 26. Thus, it is achieved that the central portion 27 having the slit 42 is in direct communication with the drink opening 32 of the spout 31, as shown in FIG. 19, whereas the outer ring-shaped portion 28 is not, as communication between the latter portion 28 and the drink opening 32 is blocked at a location where the valve membrane 26 hingably contacts the base of the spout 31, which is the location where the distinction between the central portion 27 and the outer ring-shaped portion 28 is made. Communication between the outer ring-shaped portion 28 and the drink opening 32 is also prevented by the presence of a sleeve 60, which surrounds the base of the spout 31.

The valve element 26 is provided with a valve 61 for allowing air to pass from one side of the element to the other. The valve 61 comprises a duckbill, for example. The valve 61 for allowing air to pass is arranged in the outer ring-shaped portion 28. The valve element 26 can also be provided with at least one, but preferably more than one, air channel 62. The air channels 62 for allowing air to pass are arranged on the edge of the valve membrane 26. The air channels 62 are suitable for air to pass, but are too small for liquid to flow from an interior of the drinking container 11 to outside of the interior of the drinking container 11. The valve membrane 26 can be provided with one or more air valves 61, with one or more air channels 61 or with a combination of both.

FIG. 19 illustrates how the valve membrane 26 is positioned with respect to the spout 31, and shows that the dome-shaped central portion 27 of the valve membrane 26 is present inside the spout 31 at the base of the spout 31. A sleeve 60 surrounds the central portion 27 of the valve membrane 26. The sleeve 60 is positioned around the base of the spout 31. The valve membrane 26 is held in its position and is prevented from moving by the sleeve 60 and the tight space between the drink container 11 and the cover device 5. For sake of completeness, it is noted that the valve membrane 26 may be retained inside the fifth cover device 5 in any suitable manner, for example through a connection to the housing 30 at a position close to its outer periphery, or by means of a separate retainer as is the case in the first cover device 1.

When the spout 31 is subjected to a suction action and underpressure is prevailing in the spout 31 as a result thereof, a pressure difference is obtained across the valve membrane 26, which acts on the central portion 27 of the valve membrane 26. As a result, the central portion 27 is deformed as it is pulled further into the spout 31 to some extent, wherein the slit 42 automatically opens in view of the fact that portions surrounding the slit 42 are pulled apart, as it were. The open state of the valve arrangement 20 which is thus obtained is similar to the open state of the valve arrangement 20 of the third embodiment as illustrated in FIG. 11. In this state, there is an open passage from one side of the valve membrane 26 to another, so that liquid may pass from the bottle side of the valve membrane 26 to the spout side. Due to the underpressure in the drinking container 11, caused by the suction action performed by a user through the drink opening 32 and the resulting open state of the valve arrangement 20, the air valve 61 opens so that the underpressure can be normalized due to an aeration effect. The underpressure can also be normalised by the air channels 62.

In a rest position of the valve membrane 26 in the fifth cover device 5, the slit 42 is closed. In a situation of overpressure at the bottle side of the valve membrane 26, the slit 42 is closed as well, wherein an extra tight closure is realized under the influence of tensions prevailing in the valve membrane 26. In particular, in such a situation, a pressure difference is prevailing across the entire valve membrane 26, i.e. across both the central portion 27 and the outer ring-shaped portion 28. Under the influence of this pressure difference, the outer ring-shaped portion 28 is deformed to a considerable extent. The base of the spout 31 projects inside the housing 30 along a certain distance, and the outer ring-shaped portion 28 is pressed in a direction towards the basic assembly 9, thereby moving in a space which is present between the outer ring-shaped portion 28 and the housing 30 due to the projecting arrangement of the spout 31. The outer ring-shaped portion 28 may be provided with a corrugated portion 43 as is the case in the shown example, for locally weakening the outer ring-shaped portion 28 and guaranteeing a tilting movement of a portion 44 of the outer ring-shaped portion 28 as present between the corrugated portion 43 and the contact between the base of the spout 31 and the valve membrane 26. The tilting movement is continued in the central portion 27 of the valve membrane 26, wherein portions delimiting the slit 42 are tilted and deformed, as a result of which the central portion 27 is flattened similarly to the flattened central portion 27 of the third embodiment as illustrated in FIG. 12. As a result, the slit 42 is firmly closed, and a sealing function of the valve arrangement 20 as desired in the situation of overpressure is realized. The valve membrane 26 includes a number of strengthening ribs 45,47 as is the case in the shown example, so that the lever action of the outer ring-shaped portion 28 on the central portion 27 and consequently the closing of the slit 42 may be guaranteed despite of the flexibility of the valve membrane 26. The number of strengthening ribs 45,47 may vary dependent on for example the thickness of the valve membrane 26, the length in radial length and the width in tangential direction of the strengthening ribs. In the fifth embodiment the strengthening ribs 45,47 to support the lever action are located on the bottle side of the valve membrane 26 and on central portion 27. It is the objective of the strengthening ribs 45,47 to support the lever action of the secondary portion 28 on the primary portion 27 which is supposed to take place when overpressure is prevailing in a drink container 11 as covered by the cover device 5. The strengthening ribs 47 on the central portion 27 of the valve membrane 26 support the slit 42 in closing upon underpressure in the drink container 11. One of the strengthening ribs 45 may be an elongated strengthening rib 46, such that the rib 46 extends further from the valve membrane 26. The elongated strengthening rib 46 functions as a handle. The handle 46 enables a user to easily remove the valve membrane 26 from the cover device 5. The user can then easily clean the valve membrane 26 and the cover device 5.

It will be clear to a person skilled in the art that the scope of the present invention is not limited to the examples discussed in the foregoing, but that several amendments and modifications thereof are possible without deviating from the scope of the present invention as defined in the attached claims. While the present invention has been illustrated and described in detail in the figures and the description, such illustration and description are to be considered illustrative or exemplary only, and not restrictive. The present invention is not limited to the disclosed embodiments.

Variations to the disclosed embodiments can be understood and effected by a person skilled in the art in practicing the claimed invention, from a study of the figures, the description and the attached claims. In the claims, the word "comprising" does not exclude other steps or elements, and the indefinite article "a" or "an" does not exclude a plurality. The mere fact that certain measures are recited in mutually different dependent claims does not indicate that a combination of these measures cannot be used to advantage. Any reference signs in the claims should not be construed as limiting the scope of the present invention.

For sake of clarity, it is noted that the terms "overpressure" and "underpressure" as used in this text are understood such as to imply a higher pressure than ambient pressure and a lower pressure than ambient pressure, respectively.

Furthermore, it is noted that the basic assembly 9 does not necessarily need to be equipped with a spout 31, as long as it is possible for a user of the cover device 1; 2; 3; 4; 5 to drink from the drink opening 32 by exerting a suction force. It is practical for the drink opening 32 to be present at an end of an element projecting from a housing 30, as is the case with a spout 31, but this is not essential within the framework of the present invention. In every embodiment of the cover device 1; 2; 3; 4; 5, a path to be followed by liquid to the drink opening 32 can easily be discerned by a person skilled in the art, so that the passage which is blocked and unblocked by the valve arrangement 20 can unambiguously be identified.

The present invention can be summarized as follows. A cover device 1; 2; 3; 4; 5 for a drink container 11 comprises a basic assembly 9 which is provided with at least one drink opening 32. In a practical embodiment, the basic assembly 9 may comprise a housing 30 and a spout 31 which projects from the housing 30 and which has the drink opening 32 at a free end thereof. The cover device 1; 2; 3; 4; 5 further comprises a valve arrangement 20 which is adapted to assume a closed state for blocking a passage to the drink opening 32 in the basic assembly 9 from a side of the cover device 1; 2; 3; 4; 5 which is intended to face the drink container 11, and to assume an opened state for unblocking the passage as mentioned. In particular, the valve arrangement 20 comprises an element 21; 26; 50 which is hingably associated with a supporting surface portion of the basic assembly 9, wherein the valve element 21; 26; 50 has two portions 23, 24; 27, 28; 52, 53, 54 which are connected to each other through an area of the valve element 21; 26; 50 which is present at a position where the valve element 21; 26; 50 is hingably associated with the supporting surface portion of the basic assembly 9, and wherein only one of the two portions 23, 24; 27, 28; 52, 53, 54 of the valve element 21; 26; 50 is in direct communication with the drink opening 32 of the basic assembly 9.

Due to the fact the only one of the two portions 23, 24; 27, 28; 52, 53, 54 of the valve element 21; 26; 50 is in direct communication with the drink opening 32 of the basic assembly 9, and the other of the two portions 23, 24; 27, 28; 52, 53, 54 is not, it is possible to have different reactions of the valve element 21; 26; 50 on underpressure prevailing at a side of the valve element 21; 26; 50 which is associated with the drink opening 32, which is realized when a user wants to drink and exerts a suction force through the drink opening 32 for that purpose, and overpressure prevailing at a drink container side of the flexible element 21; 26; 50, even though the pressure differences across the valve element 21; 26; 50 can be comparable for both situations, at least as far as their direction is concerned. Due to this fact, it is possible for the cover device 1; 2; 3; 4; 5 to have a leakproof nature, while the valve arrangement 20 can be very well responsive to a suction action, so that the user is not compelled to exert a high suction force.

The different reactions of the valve element 21; 26; 50 in the different situations are obtained on the basis of the fact that in the first situation, only the portion 23; 27, 28; 54 of the valve element 21; 26; 50 which is under the direct influence of the drink opening 32 of the basic assembly 9 is addressed, whereas in the second situation, both portions 23, 24; 27, 28; 52, 53, 54 of the valve element 21; 26; 50 are addressed. In particular, the design of the valve element 21; 26; 50 and the design of the basic assembly 9 in which the valve element 21; 26; 50 is accommodated are chosen such that in the second situation, the portion 23; 27, 28; 54 of the valve element 21; 26; 50 which is under the direct influence of the drink opening 32 is exerted to a lever action by the other portion 24; 27, 28; 52, 53, wherein the lever action is stronger than the inclination of the first portion 23; 27, 28; 54 to respond to a pressure difference in the same way as in the first situation. Among other things, this effect may be achieved by letting the one portion 23; 27, 28; 54 be smaller than the other portion 24; 27, 28; 52, 53, provided that distances of the one portion 23; 27, 28; 54 to a hinge area are not very much larger than distances of the other portion 24; 27, 28; 52, 53 to the hinge area. In general, according to the present invention, sizing, positioning and orientation of the portions 23, 24; 27, 28; 52, 53, 54 of the valve element 21; 26; 50 are realized for having a smaller total moment of force on a portion 23; 27, 28; 54 of the valve element 21; 26; 50 which is in direct communication with the drink opening 32 of the basic assembly 9 than on another portion 24; 27, 28; 52, 53 of the valve element 21; 26; 50 not being in direct communication with the drink opening 32, when the valve element 21; 26; 50 is subjected to pressure from the side of the cover device 1; 2; 3; 4; 5 which is intended to face the drink container 11.

In respect of the thresholds for opening and closing the valve arrangement 20, it is noted that the values thereof may be determined by a design factor such as the position on the valve element 21; 26; 50 of the hinge association with the surface portion of the basic assembly 9.

In the examples as described in the foregoing with reference to the figures, the hinge association of the valve element 21; 26; 50 with the supporting surface portion of the basic assembly 9 is a hinge contact. That does not alter the fact that within the framework of the present invention, it is also possible for the hinge association to be a hinge connection. For example, in the case of the second cover device 2, the valve membrane 26 may be connected to the inner ring-shaped member 37 instead of only contacting the ring-shaped member 37, wherein the connection is at a side of the valve membrane 26, at a position where the hinging effect takes place. Alternatively, a ring-shaped member can be provided as a standing part of a membrane, wherein the connection is at a top edge of the ring-shaped member. The hinging effect does not necessarily need to be present at the position of the connection. For example, in the latter case, the connection may be located at the top edge of the ring-shaped member, whereas a hinge may be present at a position at a bottom edge of the ring-shaped member, i.e. a position where the ring-shaped member is attached to the membrane, wherein the hinge may be realized by letting the ring-shaped member at the bottom side be sufficiently thin, to mention one possibility. In any case, it is possible to discern a valve element 21; 26; 50 which is arranged for assuming different positions/appearances with respect to the basic assembly 9 and thereby controlling an extent to which a passage to the drink opening 32 of the basic assembly 9 is blocked, wherein two portions 23, 24; 27, 28;

52, 53, 54 can be distinguished on the valve element 21; 26; 50, which are separated by association to another element, which may be a separate element or an integral element, as explained in the foregoing, which has a function in suspending/supporting the valve element 21; 26; 50 from/on a supporting surface portion of the basic assembly 9, wherein the association is such that hinging movements of the element 21; 26; 50 are allowed to take place under the influence of the various possible pressures acting on the element 21; 26; 50.

The invention claimed is:

1. A cover device for a drink container, the cover device comprising:

a basic assembly that includes a housing with a spout portion, the housing having a locally supporting hinge contact surface portion, and the spout portion having a drink opening; and a valve arrangement that comprises a valve element having first and second portions which are integral with each other through an area of the valve element that corresponds with a position of the locally supporting hinge contact surface portion in response to the valve element being hingably associated with the basic assembly at the locally supporting hinge contact surface portion, wherein only the first portion of the valve element is configured for being directly influenced, via a passage to the drink opening, to block or unblock the passage to the drink opening, wherein the second portion of the valve element is not configured for being directly influenced, via the passage to the drink opening, to block or unblock the passage to the drink opening, and wherein the first and second portions of the valve element are configured in size, position, and orientation for (i) assuming a leak-proof closed state that includes the valve element having a smaller total moment of force on the first portion of the valve element than on the second portion of the valve element in response to the valve element being subjected to an overpressure prevailing at a side of the cover device adapted to face the drink container, and (ii) assuming an open state in response to the valve element being subjected to an underpressure prevailing from a side of the cover device having the drink opening.

2. The cover device according to claim 1, wherein the first portion of the valve element is smaller than the second portion of the valve element.

3. The cover device according to claim 1, wherein the first portion of the valve element comprises a projecting edge portion for contacting a surface portion of the basic assembly, wherein the valve arrangement assumes the closed state in response to the projecting edge portion making contact with the surface portion of the basic assembly, and wherein the valve arrangement assumes the open state in response to the projecting edge portion being separated at a distance from the surface portion of the basic assembly.

4. The cover device according to claim 1, wherein the valve element comprises flexible material.

5. The cover device according to claim 1, wherein the first portion of the valve element comprises a ring-shaped portion at a side of an inner periphery of the valve element, and wherein the second portion of the valve element comprises a ring-shaped portion at a side of an outer periphery of the valve element.

6. An assembly of a drink container and the cover device according to claim 1, wherein the cover device is removably attached to the drink container.

* * * * *